US005092603A

United States Patent [19]

Schindler

[11] Patent Number: 5,092,603

[45] Date of Patent: Mar. 3, 1992

[54] GOLF CLUB PRACTICE AID AND SYSTEM

[76] Inventor: Charles T. Schindler, 778 Ashler Ct., Worthington, Ohio 43235

[21] Appl. No.: 706,451

[22] Filed: May 28, 1991

[51] Int. Cl.[5] ..... A63B 69/36

[52] U.S. Cl. ..... 273/186 A; 273/194 A; 273/187 A; 273/183 A

[58] Field of Search ..... 273/163 R, 347, 186 C, 273/345, 163 A, 194 A, 186 A, 183 D, 183 E, 183 A, 186 R

[56] References Cited

U.S. PATENT DOCUMENTS

| | | | |
|---|---|---|---|
| 653,023 | 7/1900 | Holden | 273/163 R |
| 2,683,037 | 7/1954 | Ruczynski | 273/345 |
| 3,161,410 | 12/1964 | Cunningham | 273/347 X |
| 3,273,891 | 9/1966 | Grim, Jr. | 273/163 R |
| 3,325,168 | 6/1967 | Fyanes | 273/186 A |
| 3,649,029 | 3/1972 | Worrell | 273/186 C |
| 3,934,882 | 1/1976 | Whittaker | 273/183 A |
| 4,235,440 | 11/1980 | Hinckley | 273/183 A |
| 4,575,090 | 3/1986 | Heseltine | 273/183 D |
| 4,765,625 | 8/1988 | Miner | 273/183 A |
| 4,789,158 | 12/1988 | Chiesa | 273/163 A |

*Primary Examiner*—George J. Marlo
*Attorney, Agent, or Firm*—David A. Greenlee

[57] ABSTRACT

A practice system for improving the stroke accuracy of a golf putter comprises an alignment mat having an elongated base positionable on a putting surface. Its upper surface has an elongated, straight, visible alignment stripe, an orientation stripe perpendicular to and intersecting the alignment stripe, and a ball hole located at the stripe intersection. An indicator having a base, a rod extending from the base, and an adhesive material mounted in a recess on the base is configured for mounting the indicator on the putter with the indicator rod perpendicular to the putter face. Alignment of the rod with the alignment stripe during a putting stroke indicates a putting stroke colinear with a desired "line". A target comprising a circular disk the size of a golf hole is placed a preselected distance from the alignment mat in alignment with the alignment stripe. The path of a ball, that is placed in the mat hole and struck with a putter having the indicator installed, which crosses the target indicates colinearity of the putting stroke with the alignment stripe and perpendicularity of the putter face to the alignment stripe when the ball is struck. The mat includes a plurality of spaced indication stripes, parallel to the orientation stripe, extending from the ball hole in both directions to indicate the length of the backswing and followthrough.

12 Claims, 2 Drawing Sheets

GOLF CLUB PRACTICE AID AND SYSTEM

BACKGROUND OF THE INVENTION

This invention relates generally to accessories for golf clubs and, more particularly, to a practice aid and practice system for improving a golfer's putting stroke.

It has been often said that "you drive for show, but you putt for dough." This statement illustrates that putting is the single most important part of the game of golf Fully one half of the strokes on a par 72 golf course are allotted for putting—two strokes per hole. Sub-par rounds are most frequently attained by reducing the number of putts taken.

While being most important, putting is also the most exacting and difficult part of the game. One reason for the difficulty of putting is that the club and stroke utilized for putting are vastly different from all other clubs and strokes used to advance a golf ball from tee to hole. Whereas a variety of different wood and iron clubs are available to advance a golf ball from tee to green, only a single club—the putter—is utilized for moving the ball on the green into the hole.

The wood and iron clubs all incorporate club faces having varying degrees of loft to enable a struck golf ball to elevate and travel substantial distances through the atmosphere. Air travel is desirable, while surface travel (the ubiquitous "worm burner") is not, since air offers less resistance than does grass.

In contrast, the face of a putter has virtually no loft, for putting involves rolling a ball along the contours of the surface of a green. Air travel is undesirable, since it restricts accuracy, and moving the ball substantial distances is unnecessary.

Effectively stroking a golf ball with the woods and irons requires a golfer to take a strong swing to accelerate the clubhead and strike the ball with substantial force to move it great distances. The amount of force varies with the distance requirements of a particular shot. Distances for wood and iron shots are estimated and quoted in yards, usually in five- or ten-yard increments. A successful shot can be one that varies as much as ten or twenty yards in distance, and be as much as ten or fifteen yards off-line from the ideal. Of course, standards of success for short, lofted pitch shots are a bit more stringent than for drives, fairway and long approaches.

In great contrast, putting distances are estimated and quoted in feet, sometimes in half-feet (as in "three-and-a-half foot birdie putt"). A putt that is off line as little as one-half inch can be disastrous (as in an errant downhill putt struck firmly). The putting stroke is a carefully controlled stroke executed with a relatively weak swing, for too much force can sometimes have nasty consequences (see downhill putt, above), while too little force is nearly always unacceptable (as in "never up, never in").

Thus, while accuracy is desirable in all golf strokes, putting requires it. While a glove is customarily worn on a golfer's lead hand (left hand for "righties", right hand for "lefties") for all wood and iron shots, it is seldom worn for putting. Glove removal enhances a golfer's "feel" of the club. While all golf shots require some study and concentration, nothing compares to the time spent studying, pondering and standing over a putt.

Successful putting requires experience in reading greens and an accurate stroke to cause the ball to traverse a path predetermined to be correct. An accurate stroke requires great concentration, steady nerves, and good motor control. Most good golfers usually experience a deteriorating stroke (get the "yips") as age advances, because the ability to concentrate and motor control become more difficult with age.

Putting involves three variables. The first is a proper "line" or direction of initial ball travel (i.e. the proper aiming point). The second is proper ball speed (i.e. how hard to hit the ball) which cooperates with the proper line to enable the ball to reach a desired location, whether in the cup or nearby (as in a "lag" putt). These variables are mental determinations made by the golfer. The third variable is physical, being the proper putting stroke which will attain the proper line and ball speed. Successful putting is most dependent upon execution of a good stroke which will result in the ball physically attaining the predetermined line and speed.

Good stroke execution requires that the putter be oriented with its club face perpendicular to the desired initial direction of ball movement and that the club head be moving colinearly with this direction when the ball is struck. Many devices have been developed to improve the putting stroke. Some of these involve a special club configuration or restraint to aid a golfer in developing the desired clubhead orientation and putting stroke (backswing and followthrough). These are usually expensive, cumbersome and complicated.

It would be desirable to provide an inexpensive, convenient and simple practice aid and system for improving the putting stroke.

SUMMARY OF THE INVENTION

It is therefore an object of this invention to provide an inexpensive, simple practice aid and system for improving the putting stroke.

Accordingly, in one aspect, this invention features a practice aid for a golf club, comprising a base including a bottom and a top, an adhesive material mounted on the bottom, and an elongated arm extending from the top perpendicularly to the bottom, wherein the bottom is configured for adhering the practice aid to a golf club at any of a plurality of selected locations.

In another aspect, this invention features a practice aid for a putter having a club head with a ball-striking face, comprising a base including a bottom and a top, an adhesive material mounted on the bottom, and an elongated arm extending from the top perpendicularly to the bottom, wherein the bottom is configured for adhering the practice aid to the putter at any of a plurality of selected locations with the arm extending perpendicularly to the putter face.

In yet another aspect, this invention features a practice system for improving stroke accuracy of a golf putter having a shaft with a grip at one end and a club head with a ball-striking face at the other end. This system comprises an alignment mat having an elongated base with a bottom side positionable on a putting surface and a top side with an elongated, straight, visible alignment stripe. An indicator having a base, a rod extending perpendicularly from the base, and an adhesive material on the base can be mounted on the putter at selected locations, with the indicator arm perpendicular to the club face such that alignment of the indicator arm with the alignment stripe on the mat during a putting stroke indicates a linear putting stroke.

A further feature of this invention is that the mat includes an orientation stripe perpendicular to and intersecting the alignment stripe, and a ball location spot located at the intersection of the stripes, the alignment and orientation stripes cooperating to facilitate attachment of the indicator with its arm oriented perpendicularly to the club face.

A yet further feature of this invention is inclusion of a target comprising a circular disk the size of a golf hole and placed a preselected distance from the alignment mat in alignment with the alignment stripe, such that the path of a ball, that is placed on the mat spot and struck with a putter having the indicator mounted with its rod extending perpendicular to the putter face, which crosses the target indicates a proper stroke having colinearity of the putting stroke with the alignment stripe and perpendicularity of the putter face to the alignment stripe when the ball is struck, while a ball path that does not cross the target is indicative of an improper stroke having noncolinearity and/or perpendicularity.

These and further objects and features of this invention will become more readily apparent upon reference to the following detailed description of a preferred embodiment, as illustrated in the accompanying drawings, in which:

DETAILED DESCRIPTION OF A PREFERRED EMBODIMENT

Figure 6:
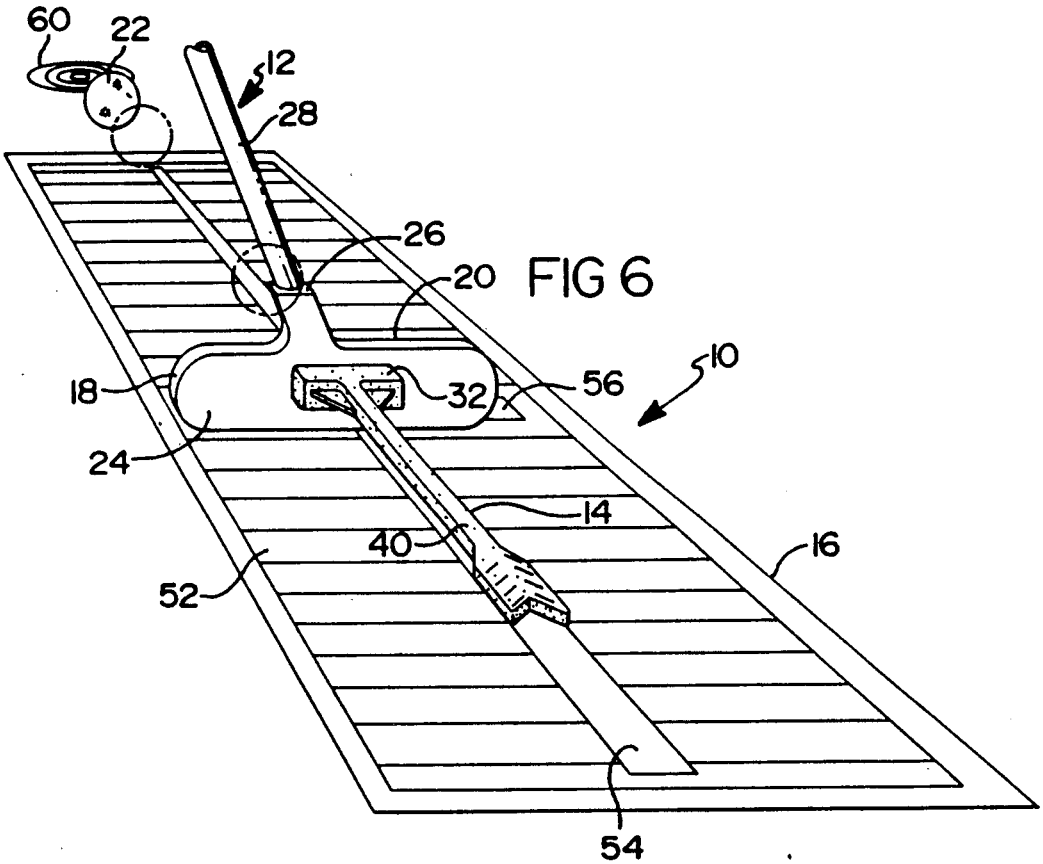
FIG. 6 is a perspective view of the practice system of this invention comprising an indicator, a mat and a target, with the system shown in operation.

Referring now to FIG. 6 of the drawings, a practice system 10 is provided for use with a putter 12 to improve a golfer's putting stroke. Practice system 10 includes a practice aid in the form of an indicator 14 and an alignment mat 16.

Figure 3:
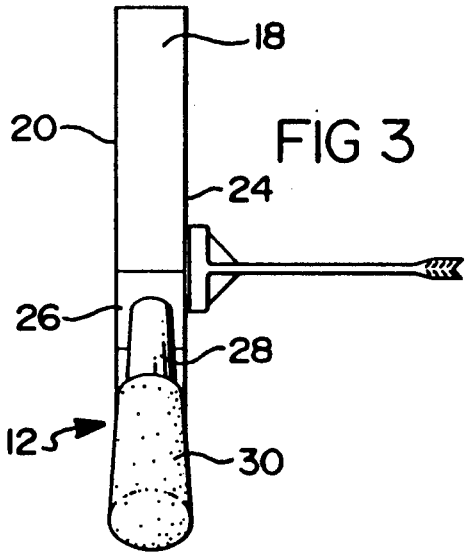
FIG. 3 is a plan view of a golf putter with the indicator of FIGS. 1 and 2 installed on the back of the club head.
Figure 4:
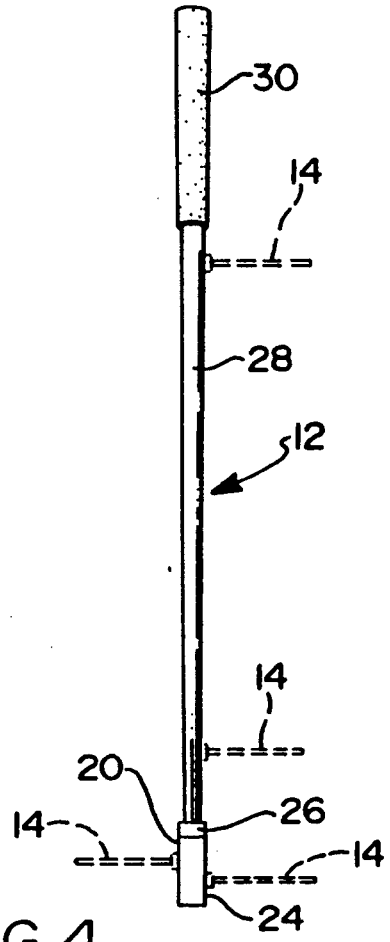
FIG. 4 is a side view of a putter, illustrating in phantom lines various points at which the indicator can be mounted.

As best seen in FIGS. 3 and 4, putter 12 includes the usual club head 18 having a front face 20, for striking a golf ball 22, and a back side 24. Club head 18 is attached by a hosel 26 to a shaft 28 that terminates in the usual grip 30. The putter 12 illustrated is exemplary only and forms no part of this invention, which is usable with all types of putters.

Figure 1:
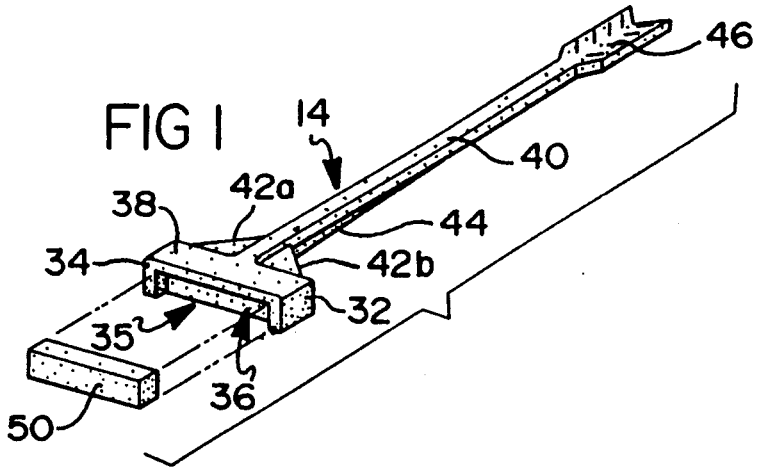
FIG. 1 is an exploded perspective view of a practice aid indicator for attachment to a golf putter, according to this invention.
Figure 2:
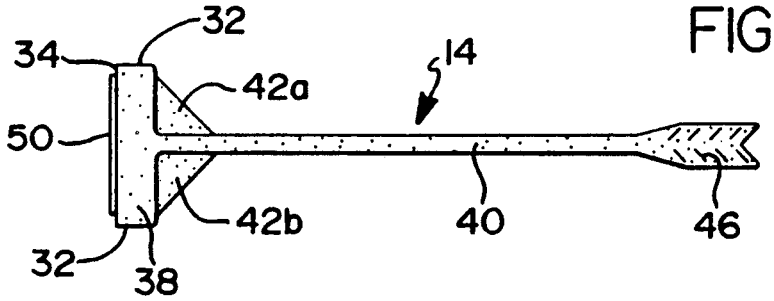
FIG. 2 is a plan view of the indicator of FIG. 1.

Referring now to FIGS. 1 and 2, indicator 14 is preferably formed of a unitary molded piece of lightweight plastic, such as polypropylene, and includes a base 32 having a rectangular bottom 34. Indicator 14 is mounted on the backside 24 of putter head 18 by pressing the adhesive 50 against the clubhead so that the rod 40 extends perpendicular rearwardly of club face 20, as illustrated in FIGS. 3 and 6. A rectangular pocket, or recess, 36 is formed in bottom 34 of three sides, having one open side 35. The top 38 of base 32 mounts an elongated rod 40, which is supported by side web flanges **42*a*, 42*b* and a lower extended support rib 44, and terminates in a head 46**.

Indicator 14 can be of any color, such as a bright white or a fluorescent color, such as orange, red or yellow. However, color is not critical, except to render the indicator readily visible to the golfer.

A piece of adhesive 50 is mounted in recess 36. The adhesive piece is dimensioned to completely fill recess, with an excess portion extending beyond the surface of bottom 34. The adhesive used is preferably a pliable filled polybutyl material that will readily adhere to a plurality of surfaces, especially the plastic and metal component parts of a putter. It should not leave any measurable residue upon removal of the indicator from the putter.

The adhesive is selectively removable from the base for replacement, if necessary. The area of the pocket contacted by the adhesive is substantially larger then the area available to engage a putter surface to assure that it will remain attached to the indicator when the latter is removed from the putter.

The adhesive material is preferably moderately tacky and capable of immovably supporting the practice aid on the putter during normal manipulation thereof. Ideally the adhesive will meet performance criteria which require one gram of material to support a 100 gram load on a vertical surface for 30 days without load movement.

Figure 5:
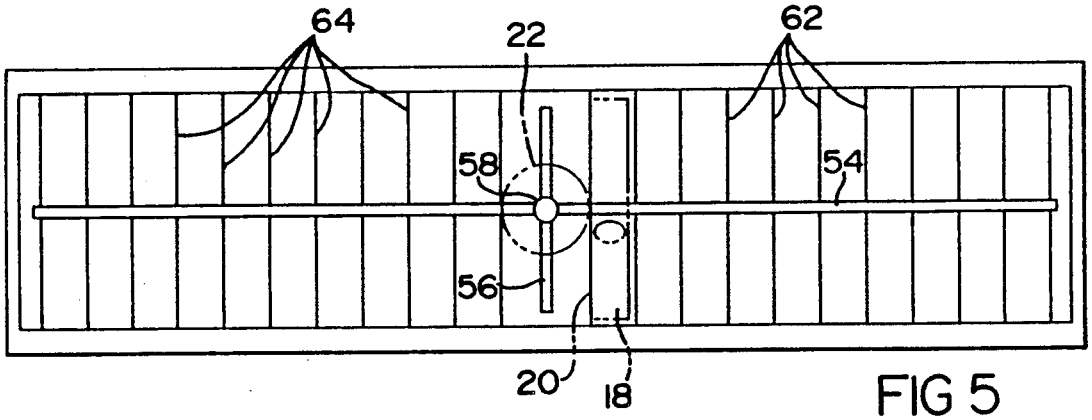
FIG. 5 is a plan view of a mat which forms part of the practice system according to this invention, with a putter and a golf ball shown in phantom lines.
Figure 7:
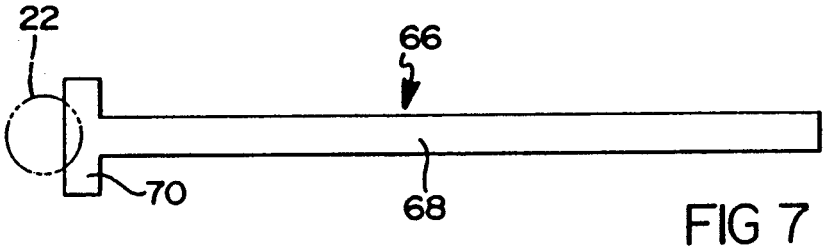
FIG. 7 is a plan view of an alternative embodiment of a mat, according to this invention.

As shown in FIGS. 5 and 7, mat 16 comprises an elongated flexible base 52 that preferably has a green background with white markings as follows. It is preferably made of a synthetic material, such as "Teslin", a PPG product. A longitudinal central alignment stripe 54 bisects base 52 longitudinally. A perpendicular lateral orientation stripe 56 intersects alignment stripe 54 approximately at its midpoint. A central ½" ball-receiving locator hole 58 is cut in the mat at the stripe intersection.

These stripes initially cooperate to assure proper installation of the indicator 14 on putter 12. The putter first is placed on mat 16 with its club face 20 aligned with orientation stripe 56, as shown in FIG. 6. Next, indicator 14 is mounted on the backside 24 of the putter at a location opposite the preferred point of ball impact on face 20. Base 32 should be manipulated to align rod 40 with alignment stripe 54. This will assure perpendicularity of rod 40 with club face 20.

Referring now to FIG. 6, the operation of system 10 will be described. Practice system 10 further includes a target 60 which is a thin circular disk having the diameter of a golf hole. To employ the practice system, target 60 is located on the practice surface, normally a flat surface covered with carpet or a rug of some type, at a convenient location. Next, mat 16 is placed on the surface at a desired distance from target 60, with alignment stripe 54 aligned with target 60.

After ball 22 is placed in locator hole 58, putter 12, with indicator 14 installed, is utilized to strike and propel ball 22 toward target 60. To assure that ball 22 does indeed reach and/or pass over target 60, the putter face 20 must be perpendicular to the intended path of ball 22 and the clubhead must be travelling along the intended path at the point of impact.

The intended path is indicated by alignment stripe 54. Thus, the person putting merely needs to keep rod 40 aligned with alignment stripe 54 during the putting stroke to assure that ball 22 will travel the intended path to target 60. Such alignment of rod 40 and stripe 54 during the stroke assures the proper colinearity of desired and actual stroke path and perpendicularity of club face and stroke direction at impact.

Certain schools of thought on putting technique prescribe certain relationships between backswing and followthrough for the putting stroke. To aid in assessing desired backswing, mat base 52 further preferably includes a plurality of equally-spaced rearwardly-extending indicator stripes 62 that are parallel to orientation stripe 56, best seen in FIG. 5. Likewise, similar forwardly-extending indicator stripes 64 are included to assess followthrough.

It will normally be desirable to practice the putting stroke repetitiously with indicator 14 and mat 16, but without ball 22. This will enable the golfer to "groove" the stroke, so that in actual play, when the indicator 14 and mat 16 cannot be used, the desired colinearity and perpendicularity will occur. The attainment of a "grooved" correct putting stroke will minimize errors caused by one of the three putting variables.

While the indicator 14 has been described as being mounted on the back side of the putter clubhead, alternative mountings are possible and contemplated. As illustrated in phantom lines in FIG. 4, the indicator can be mounted on the club face, or at various locations on the club shaft. This flexibility permits the golfer to find the location that is thought to be most comfortable and helpful during practice when many sequential practice swings are taken to "groove" the swing. The practice system described above is designed primarily for indoor use or for outdoor use on a flat, level surface. It is designed to improve the putting stroke through the use of the mat and indicator. These cooperate to indicate whether a particular stroke is correct and to develop a correct stroke through repetition. The effect of actually putting with the correct stroke is graphically demonstrated through additional use of the target and a ball.

This system is, however, adaptable to putting on an actual practice green, which is legal. In this event the mat 16 can be utilized, or a modified mat 66, shown in FIG. 7, can be used. Modified mat 66 is made of flexible material. It is T-shaped, having a narrow strip of material 68 comprising the alignment stripe headed by an intersecting strip 70 comprising the orientation stripe.

Mat 66 is quite portable and easily conforms to the contours of an actual putting green. The ball is placed at the intersection of strips 68 and 70, with strip 68 extending along the desired "line". This arrangement enables stroke practice under actual putting conditions.

While only preferred embodiments have been illustrated and described, obvious modifications thereof are contemplated within the scope of this invention and the following claims.

I claim:

1. A practice aid for a golf putter comprising a base including a bottom and a top, an elongated rod extending from the top perpendicular to the bottom, a recess formed in the bottom, and an adhesive material mounted on the bottom with a portion received within the recess and the remainder projecting beyond the recess for attaching the practice aid to a surface of the putter at any of a plurality of selected locations.

2. The practice aid of claim 1, wherein the adhesive material is a pliable material which is capable of immovably supporting the practice aid on the putter during normal manipulation thereof and adheres to the base when the base is removed from the putter surface, but is selectively removable from the base.

3. The practice aid of claim 2, wherein the practice aid comprises a unitary piece of lightweight plastic in which the base and rod are integral.

4. The practice aid of claim 3, wherein the adhesive material is so formulated that one gram of the material will support a 100 gram load on a vertical surface for 30 days without load movement.

5. The practice aid of claim 4, wherein the adhesive material is a filled polybutyl material.

6. A practice aid for a putter having a club head with a ball-striking face, comprising a unitary piece of lightweight plastic having a generally rectangular base with a recess formed on the bottom thereof, an integral elongated rod extending from the top thereof, and a plurality of integral strengthening web flanges interconnecting the rod and base adjacent the juncture thereof, and a pliable adhesive material mounted in said recess and extending therefrom to enable detachable mounting of the base in the putter with the rod extending perpendicularly to the putter face.

7. The practice aid of claim 6, wherein the adhesive material is capable of immovably supporting the practice aid on the putter during normal manipulation thereof and adheres to the base when the base is removed from the putter surface, but is selectively removable from the base.

8. A practice system for improving the stroke accuracy of a golf putter having a shaft with a grip at one end and a club head with a ball-striking club face at the other end, comprising an alignment mat having an elongated base with a bottom side positionable on a putting surface and a top side with an elongated, straight, visible alignment stripe, and an indicator having a base, a rod extending from the base, and an adhesive material mounted on the base, the base being configured for adhering the indicator to the putter at selected locations, such that alignment of the indicator rod with the alignment stripe during a putting stroke indicates a linear putting stroke.

9. The practice system of claim 8, wherein the mat includes an orientation stripe perpendicular to and intersecting the alignment stripe, and a ball location spot located at the intersection of the stripes.

10. The practice system of claim 9, wherein the ball location spot is an indentation and the mat includes a plurality of spaced indication stripes, parallel to the orientation stripe, extending from the indentation in one direction along the alignment stripe for indicating the length of a portion of the putting stroke.

11. The practice system of claim 9, wherein the spot is a hole in the mat and the spaced indication stripes extend from the hole in both directions along the alignment stripe for indicating the length of the backswing and followthrough portions of the putting stroke.

12. The practice system of claim 9, further including a target comprising a circular disk the size of a golf hole and placed a preselected distance from the alignment mat in alignment with the alignment stripe, such that the path of a ball, that is placed on the mat spot and struck with a putter having the indicator mounted with its rod extending perpendicular to the putter face, which crosses the target& indicates a proper stroke having colinearity of the putting stroke with the alignment stripe and perpendicularity of the putter face to the alignment stripe when the ball is struck, while a ball path that does not cross the target is indicative of an improper stroke having noncolinearity and/or nonperpendicularity.

* * * * *